US006155937A

United States Patent [19]

Alter

[11] Patent Number: 6,155,937

[45] Date of Patent: Dec. 5, 2000

[54] TELESCOPING NET POLE

[76] Inventor: Troy Alter, 13411 N. 59th Pl., Scottsdale, Ariz. 85254

[21] Appl. No.: 09/336,527

[22] Filed: Jun. 18, 1999

[51] Int. Cl.[7] ..... A63B 61/00

[52] U.S. Cl. ..... 473/469; 473/415; 248/507

[58] Field of Search ..... 482/51, 74, 130; 248/519, 524, 507, 542, 624, 156, 414, 121; 473/415–423, 469, 176, 466, 439, 481–484, 492–494, 473–474

[56] References Cited

U.S. PATENT DOCUMENTS

| | | | |
|---|---|---|---|
| 1,959,574 | 5/1934 | Dunscombe . | |
| 3,544,110 | 12/1970 | Dickinson . | |
| 3,952,878 | 4/1976 | Gorham . | |
| 4,425,982 | 1/1984 | Kibbie | 182/36 |
| 4,513,938 | 4/1985 | Seymour | 248/507 |
| 4,558,893 | 12/1985 | Shelly . | |
| 5,014,983 | 5/1991 | Saunders . | |
| 5,037,093 | 8/1991 | Roark, Jr. . | |
| 5,316,315 | 5/1994 | Roark, Jr. . | |
| 5,337,989 | 8/1994 | Apple | 248/519 |
| 5,393,069 | 2/1995 | Taylor | 473/416 |
| 5,540,429 | 7/1996 | Dalebout et al. . | |
| 6,003,262 | 9/1997 | Beaty | 43/12 |

FOREIGN PATENT DOCUMENTS

| | | |
|---|---|---|
| 2172207 | 9/1986 | United Kingdom . |

*Primary Examiner*—Sebastiano Passaniti
*Assistant Examiner*—Mitra Aryanpour
*Attorney, Agent, or Firm*—Frank J. McGue

[57] ABSTRACT

An in situ self storing net pole is described which has a retracted position and a raised position. The net pole comprises a sleeve flush mounted to a surface, a first telescope member being telescopically and completely received within the sleeve when in the retracted position and a second telescope member being telescopically and completely received within the first telescope member when in the retracted position. The first and second telescope members slide telescopically upward and are securable in the raised position. The net pole is adapted to have a net mounted thereto.

13 Claims, 1 Drawing Sheet

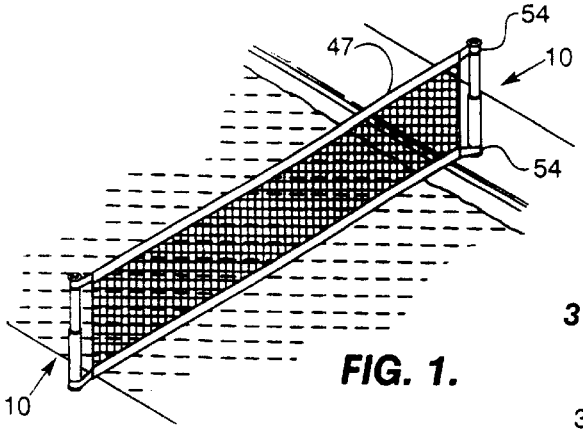
FIG. 1.
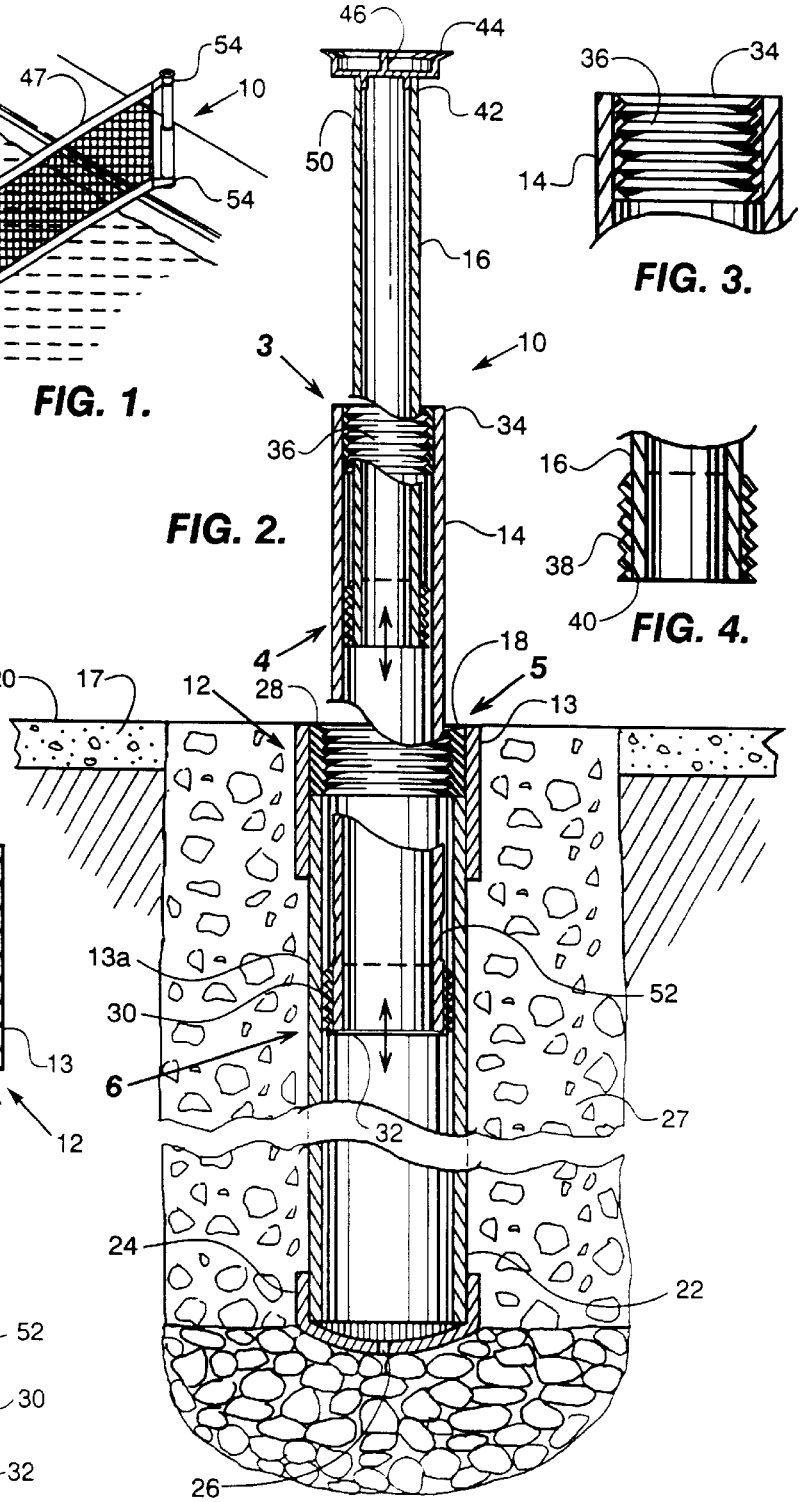
FIG. 2.
FIG. 3.
FIG. 4.
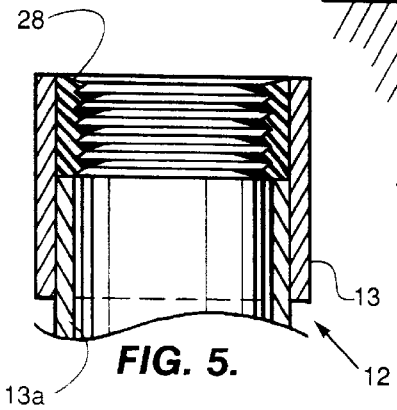
FIG. 5.
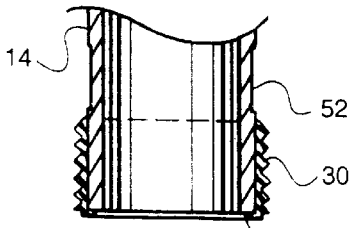
FIG. 6.

TELESCOPING NET POLE

TECHNICAL FIELD

This invention relates generally to the field of net supports used for sports, and, more particularly, to an improved telescoping net pole allowing in situ storage of same.

BACKGROUND OF THE INVENTION

There are a number of popular sports played with nets which divide a playing area into two sides. Some examples of such sports include volleyball, tennis and badminton. In general, such sports are played using a pair of poles mounted to the ground with the net supported between the pair of poles. On playgrounds and dedicated arenas for such sports, the poles may be permanently mounted into the ground which limits the possible uses for the area. In other areas, the poles are temporarily installed, as for example, in a picnic area or a swimming pool for volleyball and the like.

To mount the net in a swimming pool environment, particularly an in-ground pool, presently cylindrical bores are drilled into a pool deck on opposing sides of the pool. Each bore receives one end of a pole which extends upwardly therefrom. An appropriate net is strung between the opposing poles. To mount in a picnic area, the poles are generally staked into the ground and frequently provided with guy wires, also staked, to provide added support.

However, one problem encountered with such poles is storage when the net is not in use. Presently, the poles are removed from the bores in pool areas or removed entirely from picnic areas and stored in garages and the like, or, frequently, simply left lying on the ground. The present methods of storage are less than satisfactory since persons may not be able to find the equipment after storage, or simply may not want to make the effort to obtain such poles from storage when the urge for the game arises. Many volleyball apparatuses lay unused in garages, storage sheds and other areas for such reasons. Thus, there is a need to provide for in situ storage of net poles and the like.

U.S. Pat. No. 5,014,983 entitled "Portable Outdoor Multi Game Apparatus" which issued on May 14, 1991 to Saunders discloses a portable outdoor multi game apparatus using a telescoping basketball net support with theaded members.

U.S. Pat. No. 4,558,893 entitled "Non-Rotatable Telescoping Support Structure" which issued on Dec. 17, 1985 to Shelly shows a non-rotatable telescoping support structure with threads.

U.S. Pat. No. 5,037,093 entitled "Poolside Basketball Goal" which issued on Aug. 6, 1991 to Roark, Jr. provides a pool side anchoring system and method.

U.S. Pat. No. 3,544,110 entitled "Post Construction for Basketball Backboards" which issued on Dec. 1, 1970 to Dickinson shows a post construction for basketball backboards.

None of the known prior art disclose the combination set forth herein.

SUMMARY OF THE INVENTION

It is an object of this invention to provide a new in situ storage device for net poles and the like.

It is a further object of this invention to provide a new in situ storage device for net poles and the like which is flush mounted to a surface.

It is still another object of this invention to provide a universal storage device for poles.

Further objects and advantages of the invention will become apparent as the following description proceeds and the features of novelty which characterize this invention will be pointed out with particularity in the claims annexed to and forming a part of this specification.

BRIEF DESCRIPTION OF THE DRAWINGS

The present invention may be more readily described by reference to the accompanying drawings in which:

FIG. 1 is a perspective view of the present invention installed on a pool deck;

FIG. 2 is a cross sectional side view of the preferred embodiment of the present invention;

FIG. 3 is a cross sectional enhanced side view of the area designated by arrow 3 of FIG. 2;

FIG. 4 is a cross sectional enhanced side view of the area designated by arrow 4 of FIG. 2;

FIG. 5 is a cross sectional enhanced side view of the area designated by arrow 5 of FIG. 2; and FIG. 6 is a cross sectional enhanced side view of the area designated by arrow 6 of FIG. 2.

DESCRIPTION OF THE PREFERRED EMBODIMENT

Referring more particularly to the drawings by characters of reference, FIGS. 1–6 disclose combinations of features which constitute the components of a net pole 10 of the present invention. In the presently preferred embodiment, net pole 10 comprises a sleeve 12, a first telescope member 14 which is received within sleeve 12 and a second telescope member 16 which is received within first telescope member 14. As shown, sleeve 12 and the telescope members 14 and 16 are open ended cylinders. In one embodiment, sleeve 12, telescope members 14 and 16 are PVC piping which is 2 inches (5.1 cm), ½ inches (3.8 cm) and 1¼ (3.2 cm) in diameter, respectively.

As best seen in FIG. 2, sleeve 12 is mounted into a deck 17 whereby an upper end 18 of sleeve 10 is flush with the top surface 20 of deck 17. In the presently preferred embodiment, sleeve 12 includes a collar 13 which is flush mounted to deck 17. Collar 13 includes a first female threading 28. Being received within and extending below collar 13 is a sleeve portion 13*a*. In one embodiment, collar 13 is a 2 inch (5.1 cm) PVC coupler and sleeve portion 13*a* is 2 inch 5.1 cm) PVC piping with first female threading 28 being glued into collar 13. A lower end 22 of sleeve 10 is preferably provided with a lower cap 24 having a drainage hole 26 therethrough to allow water to drain from sleeve 10 into the surrounding ground 27.

First female threading 28 mates with a first male threading 30 which is mounted, as for example, by gluing, on the outer surface of a bottom end 32 of first telescope member 14 as best seen in FIG. 6.

As best seen in FIG. 3, on the inner surface of a top end 34 of first telescope member 14 is a second female threading 36. Second female threading 36 mates with a second male threading 38 which is mounted on the outer surface of a foot end 40 of second telescope member 16 as best seen in FIG. 4. In one embodiment, second threading 36 and 38 are fittings glued onto PVC piping.

Covering a head end 42 of second telescope member 16 is a flush cap 44 having a bore 46 therethrough. Bore 46 is preferably sized to allow for insertion of a finger whereby a user can lift cap 44, and hence second telescope member 16.

Those skilled in the art will recognize that alternate means of lifting the net pole are possible. For example, added threading on flush cap 44 corresponding to threading on collar 13 is an alternate method of securing. Finger slots or tool slots (not shown) are provided to allow engagement and disengagement of said threading.

Device 10 has a raised position denoted by upward arrows and a retracted position denoted by downward arrows in FIG. 2. In the retracted position, second telescope member 16 is completely received within first telescope member 14 which, in turn, is completely received within sleeve 12. Flush cap 44 is mounted flush with the top surface 20.

To move to the raised position, a user inserts a finger into bore 46 and lifts flush cap 44 thereby pulling second telescope member 16 upward until second male threading 38 contacts second female threading 36. At this point, first telescope member 14 is pulled upward until first male threading 30 contacts first female threading 28. As means for securing device 10 in the raised position, first and second telescope members 14 and 16 are rotated to engage the first threading 28 and 30 and second threading 36 and 38. To lower to the retracted position, the process is simply reversed.

In the presently preferred embodiments, first and second threadings 28 and 30 do not have stops therein whereby if a user continues rotation after engagement, telescope member 14 can be completely disengaged from sleeve 12. This feature allows a user an easy means for replacement of the components if damage occurs thereto.

Those skilled in the art will recognize that the described means for securing in the raised position, namely, threading, should not be limited solely to that method. Other means, for example, universal pool connection systems and the like, would certainly appropriate. The key is to secure the telescope members to the raised position.

A net 47 is mounted to the raised poles 10 as best seen in FIG. 1. Means for mounting a net thereto can include hook and loop fasteners, straps or simply ties and hooks. One embodiment is best seen in FIG. 2 wherein a top recess 50 is situated at head end 34 of second telescope member 16 and a lower recess 52 is provided at the bottom end 32 of first telescope member 14 to receive a hook and loop fastener. Straps 54 from net 47 have the corresponding hook and loop fasteners which allow net 47 to be mounted as best seen in FIG. 1. Other means are mounted to the net itself, as for example, elastic straps or are provided as mating pieces, as for example, mating hook and loop fasteners described. Other means includes tie and hook combinations.

Although only certain embodiments have been illustrated and described, it will be apparent to those skilled in the art that various changes and modifications may be made therein without departing from the spirit of the invention or from the scope of the appended claims.

What is claimed is:

1. A self storing net pole adapted to mount a net thereto, the net pole having a retracted position and a raised position, the net pole comprising:

a sleeve having an upper end and a lower end, the sleeve being mounted through a surface of a deck, the upper end being flush with the surface, a first telescope member being telescopically and completely received within the sleeve when in the retracted position, the first telescope member sliding telescopically upward to the raised position, a second telescope member being telescopically and completely received within the first telescope member when in the retracted position, the second telescope member sliding telescopically upward to the raised position, and means for securing the first telescope member and the second telescope member in the raised position, wherein the securing means comprises a first threading mounted on an inner surface of the upper end of the sleeve engaging with a corresponding first threading mounted on an outer surface of a bottom end of the first telescope member and second threading mounted on an inner surface of a top end of the first telescope member mating with corresponding second threading mounted at an outer surface of a foot end of the second telescope member, the first threading, the corresponding first threading, the second threading and the corresponding second threading being fully rotatable after disengagement whereby the first telescope member, the second telescope member and the sleeve are adapted to be separated and reattached by simple rotation of said first telescope member, second telescope members and the sleeve.

2. The device of claim 1 wherein the sleeve further comprises a collar flush mounted to a surface and a sleeve portion mounted to and extending below the collar.

3. The device of claim 1 further comprising a lower cap having a drainage hole therethrough, the lower cap being mounted to and covering the lower end of the sleeve.

4. The device of claim 1 wherein the first threading and the second threading on the respective inner surfaces of the sleeve and the first telescope member are female and the first corresponding threading and second corresponding threading mounted on the respective outer surfaces of the first telescope member and second telescope member are male.

5. The device of claim 1 further comprising a flush cap mounted to a head end of the second telescope member, the flush cap being flush mounted to a surface when the net pole is in the retracted position.

6. The device of claim 5 wherein the flush cap has a bore therethrough, the bore being sized to receive a user's finger therein.

7. The device of claim 1 further comprising means for mounting a net thereto.

8. The device of claim 7 wherein the mounting means comprises straps.

9. The device of claim 7 wherein the mounting means comprises hooks and ties.

10. The device of claim 7 wherein the mounting means comprises hook and loop fasteners.

11. A self storing net pole, the net pole having a retracted position and a raised position, the net pole comprising:

a collar flush mounted to a surface of a deck, a sleeve having an upper end and a lower end, the sleeve extending through a surface of a deck, the upper end of the sleeve being flush mounted within the collar, a lower cap having a drainage hole therethrough, the lower cap being mounted to and covering the lower end of the sleeve, a first telescope member being telescopically and completely received within the sleeve when in the retracted position, the first telescope member sliding telescopically upward to the raised position, a second telescope member being telescopically and completely received within the first telescope member when in the retracted position, the second telescope member sliding telescopically upward to the raised position, means for mounting a net to the net pole, first female threading mounted on an inner surface of the upper end of the sleeve engaging with corresponding first male threading mounted on an outer surface of a bottom end of the first telescope member and second female threading mounted on an inner surface of a top end of the first telescope member mating with corresponding second male threading mounted at an outer surface of a foot end of the second telescope member, the first threading and the second threading securing the first telescope member and the second telescope member in the raised position, the first threading, the corresponding first threading, the second threading and the corresponding second threading being fully rotatable after disengagement whereby the first telescope member, the second telescope member and the sleeve are adapted to be separated and reattached by simple rotation of said first telescope member, second telescope members and the sleeve, and a flush cap mounted to a head end of the second telescope member, the flush cap having a bore therethrough, the bore being sized to receive a user's finger therein, the flush cap being flush mounted to a surface when the net pole is in the retracted position.

12. A self storing net pole, the net pole having a retracted position and a raised position, the net comprising, in combination:

a net adapted for use in sports, a pair of net poles adapted to mount the net therebetween, each net pole comprising:

a sleeve having an upper end and a lower end, the sleeve being mounted through a surface of a deck, the upper end being flush with the surface, a first telescope member being telescopically and completely received within the sleeve when in the retracted position, the first telescope member sliding telescopically upward to the raised position, a second telescope member being telescopically and completely received within the first telescope member when in the retracted position, the second telescope member sliding telescopically upward to the raised position, and means for securing the first telescope member and the second telescope member in the raised position.

13. The self storing net pole of claim 12 wherein the securing means comprises a first threading mounted on an inner surface of the upper end of the sleeve engaging with a corresponding first threading mounted on an outer surface of a bottom end of the first telescope member and second threading mounted on an inner surface of a top end of the first telescope member mating with corresponding second threading mounted at an outer surface of a foot end of the second telescope member, the first threading, the corresponding first threading, the second threading and the corresponding second threading being fully rotatable after disengagement whereby the first telescope member, the second telescope member and the sleeve are adapted to be separated and reattached by simple rotation of said first telescope member, second telescope members and the sleeve.

* * * * *